US009376251B2

(12) United States Patent
Hong et al.

(10) Patent No.: US 9,376,251 B2
(45) Date of Patent: Jun. 28, 2016

(54) SUBSTRATE STORAGE CONTAINER

(71) Applicant: Samsung Display Co., Ltd., Yongin-City, Gyeonggi-Do (KR)

(72) Inventors: Nam-Pyo Hong, Cheonan-si (KR); Sung-Jin Joo, Asan-si (KR); Seung-Gyu Ko, Suwon-si (KR); Heung-Seok Kim, Yongin-si (KR); Sang-Kyo Shin, Asan-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 45 days.

(21) Appl. No.: 14/306,476

(22) Filed: Jun. 17, 2014

(65) Prior Publication Data

US 2015/0041361 A1 Feb. 12, 2015

(30) Foreign Application Priority Data

Aug. 7, 2013 (KR) ..... 10-2013-0093409

(51) Int. Cl.

| | |
|---|---|
| ***B65D 81/02*** | (2006.01) |
| ***B65D 85/30*** | (2006.01) |
| ***B65D 81/107*** | (2006.01) |
| *B65D 85/48* | (2006.01) |

(52) U.S. Cl.

CPC ..... *B65D 81/107* (2013.01); *B65D 85/48* (2013.01)

(58) Field of Classification Search

CPC .... B65D 57/00; B65D 25/107; B65D 81/107; B65D 85/48; H05K 13/0069; H05K 7/1417; H05K 7/1422

USPC ..... 206/449, 454–456, 593, 701, 706–709, 206/722, 723

See application file for complete search history.

(56) References Cited

U.S. PATENT DOCUMENTS

| | | | | |
|---|---|---|---|---|
| 4,798,305 | A * | 1/1989 | Laverty | B65D 25/06 206/718 |
| 7,121,407 | B2 * | 10/2006 | Hurt | A01K 97/06 206/373 |
| 8,162,147 | B1 * | 4/2012 | Ting | B65D 21/083 206/454 |
| 8,813,958 | B2 * | 8/2014 | Kuo | B65D 81/022 206/453 |
| 2008/0128310 | A1 * | 6/2008 | Kao | B65D 81/107 206/521 |
| 2013/0091809 | A1 | 4/2013 | Shi | |
| 2013/0270134 | A1 * | 10/2013 | Chen | B65D 85/48 206/320 |

FOREIGN PATENT DOCUMENTS

| | | | |
|---|---|---|---|
| JP | 2008-222263 | A | 9/2008 |
| KR | 1020080054733 | A | 6/2008 |
| KR | 1020090030420 | A | 3/2009 |
| KR | 1020100034265 | A | 4/2010 |
| KR | 20-0449843 | U | 8/2010 |
| KR | 10-1098600 | B1 | 12/2011 |

* cited by examiner

*Primary Examiner* — Jacob K Ackun
*Assistant Examiner* — Rafael Ortiz
(74) *Attorney, Agent, or Firm* — Cantor Colburn LLP

(57) ABSTRACT

A substrate storage container includes a body including a bottom surface and a plurality of sidewalls extending perpendicularly from the bottom surface in a first direction to cooperatively provide an accommodating space for receiving a substrate, a first engaging portion provided in at least one sidewall of the plurality of sidewalls of the body and including a plurality of first positioning latching members which is arranged toward the accommodating space in a second direction perpendicular to the first direction, and a first positioning block detachably engaged with the first engaging portion and including a second positioning latching member which is engaged with any one of the plurality of first positioning latching members to adjust a capacity of the accommodating space corresponding to an engagement position of the second positioning latching member in the second direction.

18 Claims, 7 Drawing Sheets

SUBSTRATE STORAGE CONTAINER

This application claims priority to Korean Patent Application No. 10-2013-0093409, filed on Aug. 7, 2013, and all the benefits accruing therefrom under 35 U.S.C. §119, the contents of which are herein incorporated by reference in their entirety.

BACKGROUND

1. Field

Exemplary embodiments relate to a substrate storage container. More particularly, exemplary embodiments relate to a container for storing a plurality of display panels.

2. Description of the Related Art

Generally, in a manufacture of flat display devices such as a liquid crystal display device, once display panels have been fabricated, the display panels may be received and protected safely in a substrate storage container during transportation to the next manufacturing stage.

SUMMARY

A conventional substrate storage container may be only suitable for storing and transporting display panels having a certain size. In order to store and transport new panel models having other sizes, a new and different container may be needed to be prepared or manufactured. Accordingly, the cost of storing and transporting new panel models having different sizes may be correspondingly increased.

Exemplary embodiments provide a substrate storage container having high space efficiency and capable of reducing a cost of storing and transporting differently sized display panels.

According to exemplary embodiments, a substrate storage container includes a body, a first engaging portion and a first positioning block. The body includes a bottom surface and a plurality of sidewalls extending perpendicularly from the bottom surface in a first direction to cooperatively provide an accommodating space for receiving a substrate. The first engaging portion is provided in at least one sidewall of the plurality of sidewalls of the body and includes a plurality of first positioning latching members that is arranged toward the accommodating space in a second direction perpendicular to the first direction. The first positioning block is detachably engaged with the first engaging portion and includes a second positioning latching member that is engaged with any one of the first positioning latching members to adjust a capacity of the accommodating space corresponding to an engagement position of the second positioning latching member in the second direction.

In exemplary embodiments, a receiving recess for receiving the first positioning block is defined in the first engaging portion.

In exemplary embodiments, a plurality of first rib of the first positioning latching members is defined in a sidewall of the receiving recess, and the second positioning latching member may be a first protrusion that is disposed in a sidewall of the first positioning block to be interference fitted with any one of the first rib recesses.

In exemplary embodiments, the first positioning block may further include a first contact pad portion that is provided on a sidewall of the first positioning block and contacts the substrate.

In exemplary embodiments, the substrate storage container may further include a second engaging portion and a second positioning block. The second engaging portion protrudes from the bottom surface of the body and includes a plurality of third positioning latching members that is arranged in a third direction toward the accommodating space. The second positioning block is detachably engaged with the second engaging portion and includes a fourth positioning latching member that is engaged with any one of the third positioning latching members to adjust a capacity of the accommodating space corresponding to an engagement position of the fourth positioning latching member in the third direction.

In exemplary embodiments, the second engaging portion may include first and second guides that face each other to receive the second positioning block.

In exemplary embodiments, a plurality of second rib recesses of the third positioning latching members is defined in at least one sidewall of the first and second guides to be spaced apart from one another in the third direction, and the fourth positioning latching member may be a second protrusion that is disposed in a sidewall of the second positioning block to be interference fitted with any one of the second rib recesses.

In exemplary embodiments, the second positioning block may further include a second contact pad portion that is provided on a sidewall of the second positioning block to contact the substrate.

In exemplary embodiments, the third direction may be perpendicular to the second direction.

In exemplary embodiments, a guide recess of the second engaging portion which is defined in the bottom surface of the body to guide and support the second positioning block.

In exemplary embodiments, the second engaging portion may further include a plurality of fifth positioning latching members that is arranged in the third direction toward the accommodating space, and the second positioning block may be engaged with any one of the fifth positioning latching members to adjust a capacity of the accommodating space corresponding to an engagement position of the fifth positioning latching members in the third direction.

In exemplary embodiments, a plurality of third rib recesses of the fifth positioning latching members is defined in a sidewall of the guide recess to be spaced apart from one another in the third direction, and the second protrusion of the second positioning block may be interference fitted with any one of the second and third rib recesses.

In exemplary embodiments, the second positioning block may further include a guiding portion that protrudes from a bottom surface of the second positioning block to be inserted into the guide recess.

In exemplary embodiments, a supporting protrusion may be disposed in a sidewall of the guide recess, a supporting recess may be defined in a sidewall of the guiding portion of the second positioning block, and the supporting protrusion may be interference fitted with the supporting recess.

In exemplary embodiments, the body may further include a subsidiary block portion that protrudes from at least one of the plurality of sidewalls of the body to support the substrate.

In exemplary embodiments, the subsidiary block portion may further include a third contact pad portion that is provided on a sidewall of the subsidiary block portion to contact the substrate.

In exemplary embodiments, the substrate storage container may further include a cover attached on the body.

In exemplary embodiments, an end of the sidewall of the body may have a step portion.

In exemplary embodiments, the body may include plastic.

In exemplary embodiments, the first positioning block may include plastic.

According to exemplary embodiments, first and second positioning blocks may be detachably engaged with any one of respective positioning latching members provided in a body to adjust a capacity of a space for accommodating a substrate.

Accordingly, in order to store and transport new panel models having other sizes from the previous stored panels, the engagement positions of the first and second positioning blocks may be controlled to adjust a capacity of the accommodating space corresponding to a size of new panel model. Thus, it may not be required to manufacture a new substrate storage container for receiving and transporting new panels having other sizes, thereby reducing manufacturing costs of a display device.

BRIEF DESCRIPTION OF THE DRAWINGS

Exemplary embodiments will be more clearly understood from the following detailed description taken in conjunction with the accompanying drawings.

FIG. 1 is an exploded perspective view illustrating exemplary embodiments of a substrate storage container in accordance with the invention.

FIG. 2 is a perspective view illustrating a body of the substrate storage container in FIG. 1.

FIG. 3 is a plan view illustrating the body in FIG. 2.

FIG. 4 is a first positioning block in the body of FIG. 3.

FIG. 5 is a plan view illustrating a second positioning block in the body of FIG. 3.

FIG. 6 is a plan view illustrating a guide recess for guiding the second positioning block in FIG. 5.

FIG. 7 is a bottom view illustrating the second positioning block in FIG. 5.

FIG. 8 is a rear view illustrating the second positioning block in FIG. 5.

FIG. 9 is a perspective view illustrating the second positioning block engaged with the guide recess in FIG. 6.

FIG. 10 is a plan view illustrating substrates having different sizes and received in the substrate storage container in FIG. 1.

FIG. 11 is a perspective view illustrating exemplary embodiments of a substrate storage container in accordance with the invention.

DETAILED DESCRIPTION

Figure 1:
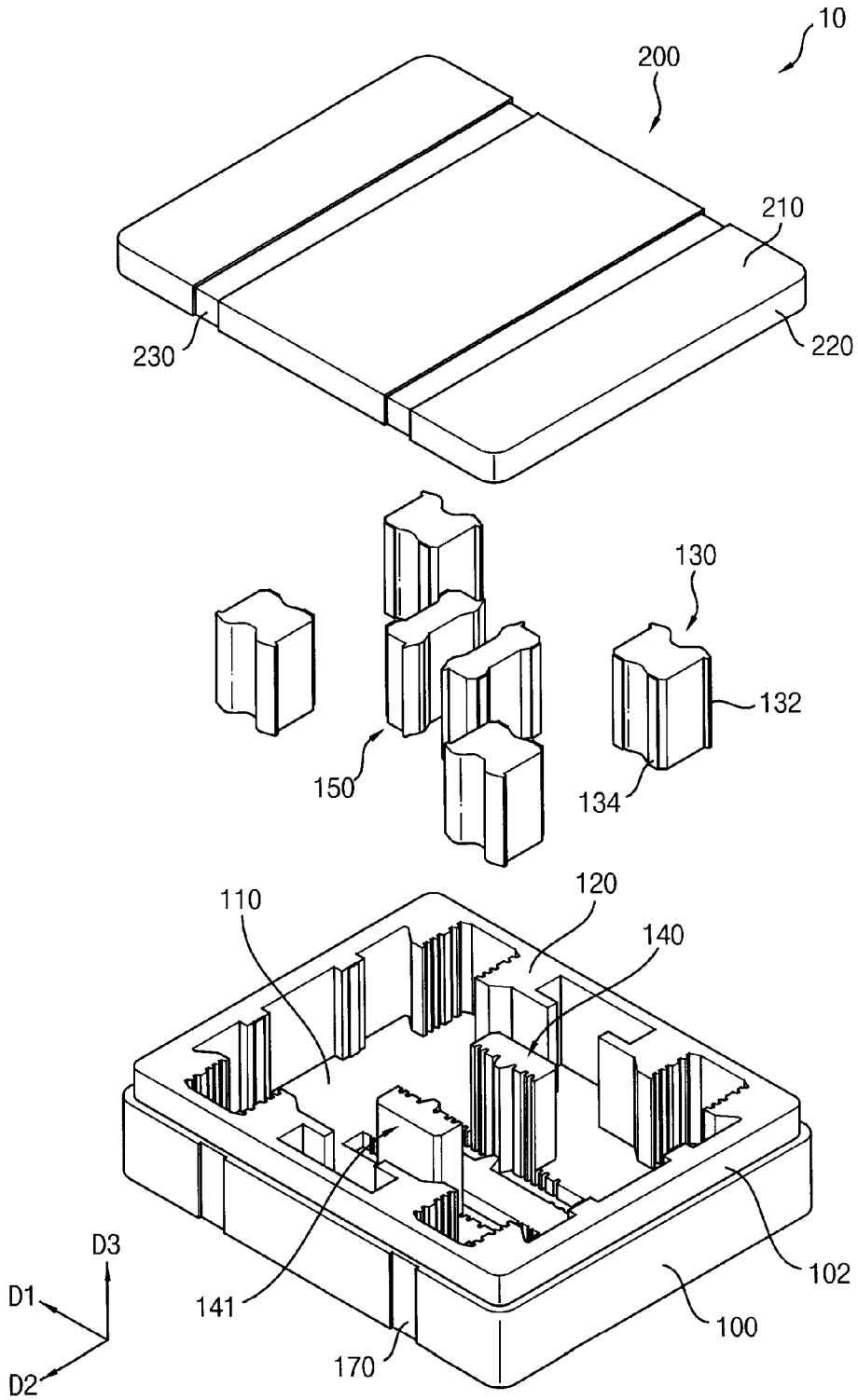
FIGS. 1 to 11 represent non-limiting exemplary embodiments as described herein.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments will be explained in detail with reference to the accompanying drawings.

Figure 2:
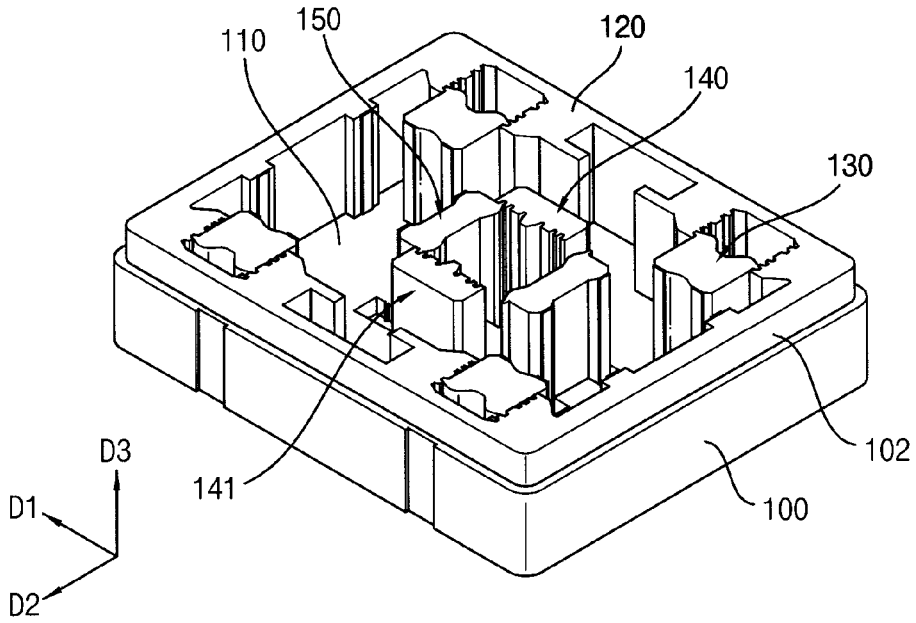
Figure 3:
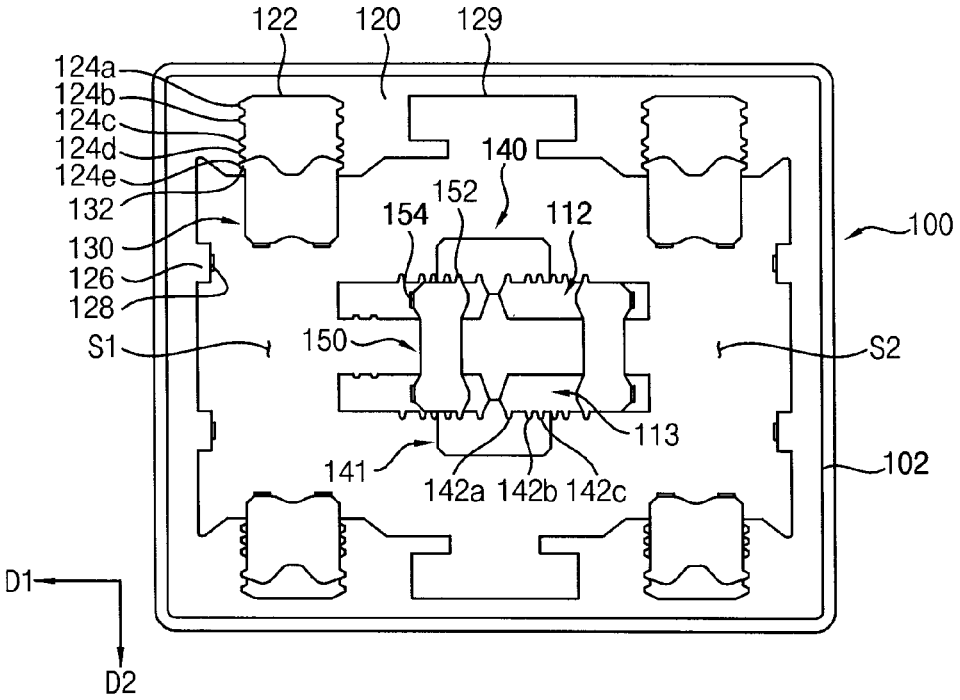
Figure 4:
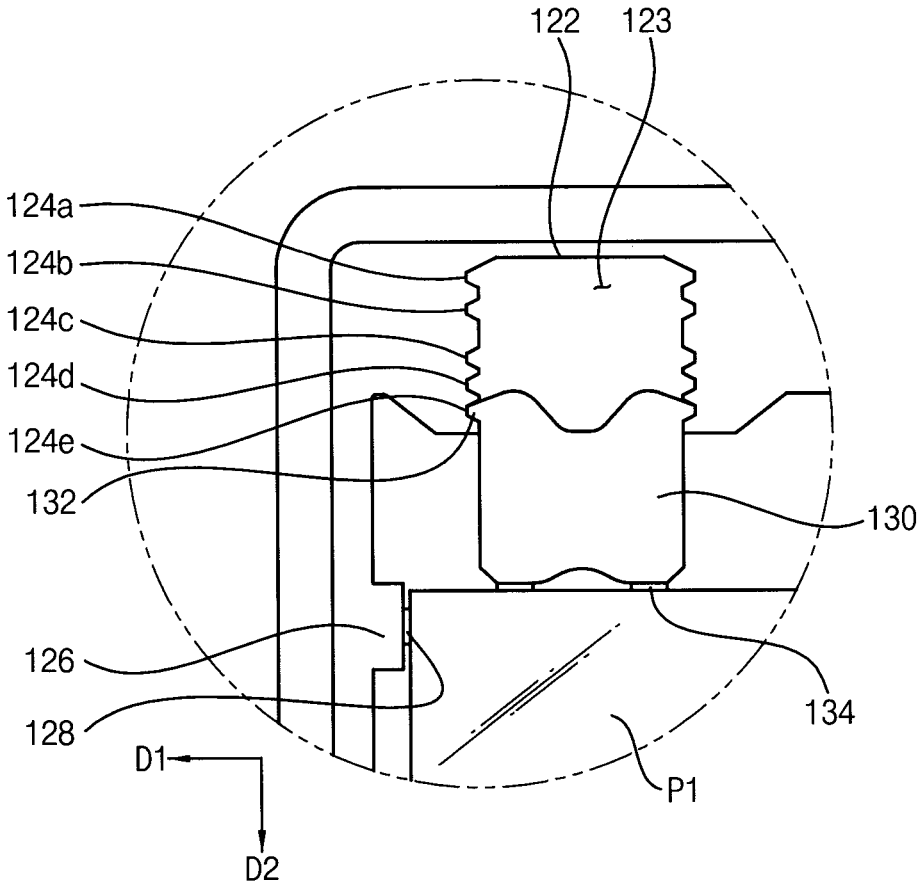
Figure 5:
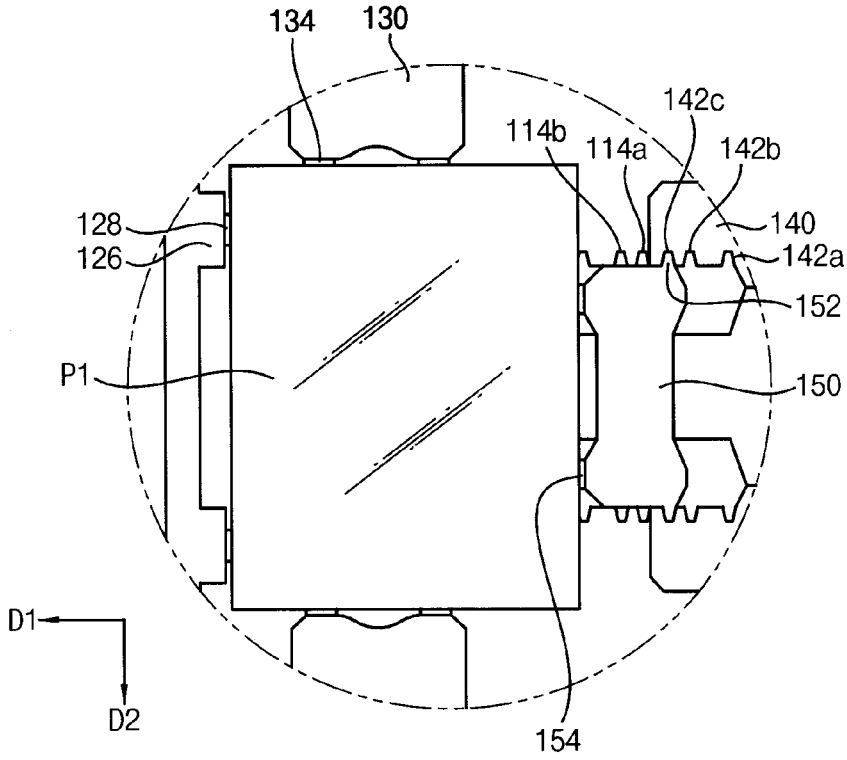

FIG. 1 is an exploded perspective view illustrating a substrate storage container in accordance with exemplary embodiments. FIG. 2 is a perspective view illustrating a body of the substrate storage container in FIG. 1. FIG. 3 is a plan view illustrating the body in FIG. 2. FIG. 4 is a first positioning block in the body of FIG. 3. FIG. 5 is a plan view illustrating a second positioning block in the body of FIG. 3.

Referring to FIGS. 1 to 5, a substrate storage container 10 may include a body 100 providing accommodating spaces S1 and S2 for receiving substrates and at least one first positioning block 130 and at least one second positioning block 150 detachably engaged with the body 100 and adjusting a capacity of the accommodating spaces S1 and S2.

In exemplary embodiments, the body 100 may include a lower plate having a bottom surface 110 and a plurality of sidewalls 120 extending perpendicularly from the lower plate in a first direction D3. In the illustrated exemplary embodiment, the first direction D3 is perpendicular to a third direction D1 and a second direction D2, and the third direction D1 and the second direction D2 are perpendicular to each other. The bottom surface 110 and the sidewalls 120 may cooperatively provide the accommodating spaces S1 and S2.

In an exemplary embodiment, the body 100 may include four sidewalls 120 and have a substantially rectangular shape. Accordingly, the accommodating spaces S1 and S2 may be defined in the body 100 to be opened in an upward direction (i.e., first direction D3). However, the invention is not limited thereto, and the body 100 may have various other shapes.

The substrate storage container 10 may store a substrate such as a display panel, for example, in the accommodating spaces S1 and S2. In an exemplary embodiment, the display panel may include a thin film transistor ("TFT") substrate, a color filter substrate and a crystal liquid layer interposed therebetween, for example. However, it may be understood that the substrate may not be limited thereto.

The substrate storage container 10 may further include a cover 200. The cover 200 may be attached to the body 100. The cover 200 may include an upper plate 210 and a plurality of sidewalls 220 extending perpendicularly from the upper plate 210.

In exemplary embodiments, at least one first positioning block 130 and at least one second positioning block 150 may be detachably engaged with the body 100 to control a capacity of the accommodating spaces S1 and S2.

A first engaging portion for engaging the first positioning block 130 and a second engaging portion for engaging the second positioning block 150 may be provided in the body 100.

As illustrated in FIGS. 3 and 4, the first engaging portion may be defined in at least one sidewall 120 of the sidewalls of the body 100. The first engaging portion may include a plurality of first positioning latching members that is arranged in the second direction D2 toward the accommodating space S1. The first positioning block 130 may include a second positioning latching member that is engaged with any one of the first positioning latching members to adjust a capacity of the accommodating space 51 corresponding to the engagement position in the second direction D2.

In an exemplary embodiment, a receiving recess 122 for receiving the first positioning block 130 may be defined in the first engaging portion. A gap 123 for receiving at least a portion of the first positioning block 130 may be defined in the receiving recess 122. A plurality of first rib recesses 124*a*, 124*b*, 124*c*, 124*d* and 124*e* of the first positioning latching members is defined in a sidewall of the receiving recess 122 to be spaced apart from one another in the second direction D2. The first rib recesses 124*a*, 124*b*, 124*c*, 124*d* and 124*e* may be defined respectively in both sidewalls of the receiving recess 122 opposite to each other. The first rib recess 124*a*, 124*b*, 124*c*, 124*d* and 124*e* may extend in the upward direction D3.

The second positioning latching member of the first positioning block 130 may include a first protrusion 132. The first protrusion 132 may be disposed in a sidewall of the first positioning block 130 to be interference fitted with any one of the first rib recesses 124*a*, 124*b*, 124*c*, 124*d* and 124*e*. The first protrusion 132 may be disposed respectively in both sidewalls of the first positioning block 130 opposite to each other. The first protrusion 132 may extend in the upward direction D3.

Accordingly, the first protrusion 132 of the first positioning block 130 may be interference fitted with any one of the first rib recesses 124*a*, 124*b*, 124*c*, 124*d* and 124*e* of the receiving recess 122.

When the first rib recess 124*a*, 124*b*, 124*c*, 124*d* or 124*e* fitted with the first protrusion 132 of the first positioning block 130 is closer to the accommodating space S1, the capacity of the accommodating space S1 becomes smaller so that the first positioning block 130 may contact and support a substrate having a smaller size in the body 100. When the first rib recess 124*a*, 124*b*, 124*c*, 124*d* or 124*e* fitted with the first protrusion 132 of the first positioning block 130 is farther from the accommodating space S1, the capacity of the accommodating space S1 becomes greater so that the first positioning block 130 may contact and support a substrate having a greater size in the body 100.

Accordingly, the first positioning block 130 may be engaged with the receiving recess 122 of the body 100 at a desired position corresponding to a size of a substrate to adjust a capacity of the accommodating space S1.

As illustrated in FIGS. 3 and 5, the second engaging portion may be provided to protrude from the bottom surface 110 of the body 100. The second engaging portion may include a plurality of third positioning latching members that is arranged in the third direction D1 toward the accommodating space S1. The second positioning block 150 may include a fourth positioning latching member that is engaged with any one of the third positioning latching members to adjust a capacity of the accommodating space S1 corresponding to the engagement position in the third direction D1.

In an exemplary embodiment, the second engaging portion may include first and second guides 140 and 141 facing each other for receiving the second positioning block 150. The first and second guides 140 and 141 may protrude from the bottom surface 110 of the body 100. The third positioning latching members may include a plurality of second rib recesses 142*a*, 142*b* and 142*c* that is defined in at least one sidewall of the first and second guides 140 and 141 to be spaced apart from one another in the third direction D1. The second rib recesses 142*a*, 142*b* and 142*c* may be defined respectively in the sidewalls of the first and second guides 140 and 141 opposite to each other. The second rib recesses 142*a*, 142*b* and 142*c* may extend in the upward direction D3.

The fourth positioning latching member may be a second protrusion 152. The second protrusion 152 may be disposed in a sidewall of the second positioning block 150 to be interference fitted with any one of the second rib recesses. The second protrusion 152 may be disposed respectively in both sidewalls of the second positioning block 150 opposite to each other. The second protrusion 152 may extend in the upward direction D3.

Accordingly, the second protrusion 152 of the second positioning block 150 may be interference fitted with any one of the second rib recesses 142*a*, 142*b* and 142*c*.

When the second rib recess fitted with the second protrusion 152 of the second positioning block 150 is closer to the accommodating space S1, the capacity of the accommodating space S1 becomes smaller so that the second positioning block 150 may contact and support a substrate having a smaller size in the body 100. On the contrary, when the second rib recess fitted with the second protrusion 152 of the second positioning block 150 is farther from the accommodating space S1, the capacity of the accommodating space S1 becomes greater so that the second positioning block 150 may contact and support a substrate having a greater size in the body 100.

Accordingly, the second positioning block 150 may be engaged with the guide protruding from the bottom surface 110 of the body 100 at a desired position corresponding to a size of a substrate to adjust a capacity of the accommodating space S1.

In an exemplary embodiment, the first positioning block 130 may adjust a longitudinal size of the accommodating space S1 corresponding to the engagement position in the second direction D2 and the second positioning block 152 may adjust a transverse size of the accommodating space S1 corresponding to the engagement position in the third direction D1.

The first engaging portion may be provided in each of the sidewalls of the body 100 opposite to each other. In this case, the receiving recesses 122 may be provided in the sidewalls of the body 100 opposite to each other and the first positioning blocks 130 may be detachably engaged with the receiving recesses 122, respectively. Accordingly, two first positioning blocks 130 may cooperatively adjust a longitudinal size of a substrate to be stored in the substrate storage container 10.

As illustrated in FIG. 4, the first rib recesses 124*a*, 124*b*, 124*c*, 124*d* and 124*e* may be spaced apart from one another by a predetermined distance in the second direction D2. In an exemplary embodiment, the first protrusions 132 of the first positioning block 130 may be engaged with the first rib recesses 124*a*, 124*b*, 124*c*, 124*d* and 124*e* in the opposing sidewalls of the receiving recess 122 respectively such that two first positioning blocks 130 may cooperatively adjust a longitudinal size of a substrate to be stored.

In exemplary embodiments, the body 100 may further include a subsidiary block portion 126. The subsidiary block portion 126 may protrude from at least one of the sidewalls of the body 100 to support the substrate. The subsidiary block portion 126 may be arranged to face the second positioning block 150. Accordingly, the second positioning block 150 and the subsidiary block portion 126 may cooperatively adjust a transverse size of a substrate to be stored in the body 100.

As illustrated in FIG. 5, the second rib recesses 142*a*, 142*b* and 142*c* may be spaced apart from one another by a predetermined distance in the third direction D1. In an exemplary embodiment, the second protrusions 152 of the second positioning block 150 may be engaged with the second rib recesses of the first and second guides 140 and 141 respectively such that the second positioning block 150 and the subsidiary block portion 126 may cooperatively adjust a transverse size of a substrate to be stored.

In exemplary embodiments, the first positioning block 130 may further include a first contact pad portion 134 (refers to FIG. 4) that is provided on a sidewall of the first positioning block 130 to contact the substrate. The second positioning block 150 (refers to FIG. 5) may further include a second contact pad portion 154 that is provided on a sidewall of the second positioning block 150 to contact the substrate. The subsidiary block portion 126 may further include a third contact pad portion 128 that is provided on a sidewall of the subsidiary block portion 126 to contact the substrate. In an exemplary embodiment, the first, second and third contact pad portions 134, 154 and 128 may include a resilient material such as rubber, for example. However, the invention is not limited thereto, and the first, second and third contact pad portions 134, 154 and 128 may include various other materials.

A buffer space 129 (refers to FIG. 3) between adjacent receiving recesses 122 may be further defined in the body 100. In an exemplary embodiment, a dehumidifying agent may be disposed in the buffer space 129 to effectively reduce the level of humidity in the body 100 in order to store substrates for long time.

In an exemplary embodiment, the body 100, the first positioning block 130 and the second positioning block 150 may include a plastic material. In the exemplary embodiment the plastic material may be expanded polypropylene ("EPP"), for example. However, the invention is not limited thereto, and second positioning block 150 may include various other types of plastic materials.

As mentioned above, the first and second positioning blocks 130 and 150 may be detachably engaged with any one of respective positioning latching members to control a capacity of a space S1, S2 for accommodating a substrate.

In order to store and transport new panel models having different sizes from the previous stored panels, the first and second positioning blocks 130 and 150 may be detached from the body 100, and then, the first and second position blocks 130 and 150 may be engaged with the body 100 at a desired position corresponding to the size of the new panel substrate to adjust a capacity of the accommodating space.

Accordingly, the engagement positions of the first and second positioning blocks 130 and 150 may be determined to adjust a capacity of the accommodating space corresponding to a size of new panel model. Thus, it may not be required to manufacture a new substrate storage container for receiving a new panel model, thereby effectively reducing manufacturing costs.

Hereinafter, a second engaging portion for engaging with the second positioning block in FIG. 5 will be explained further in detail.

Figure 6:
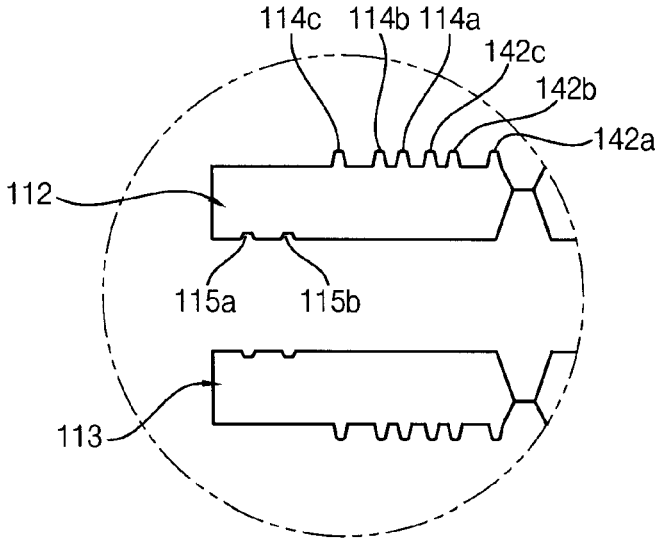
Figure 7:
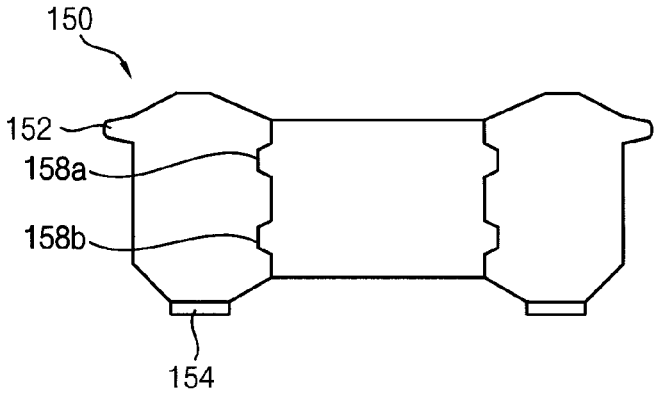
Figure 8:
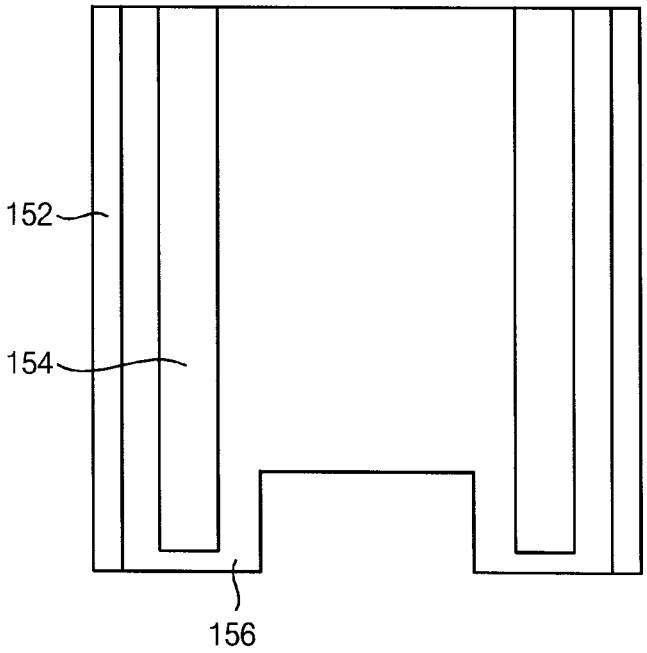
Figure 9:
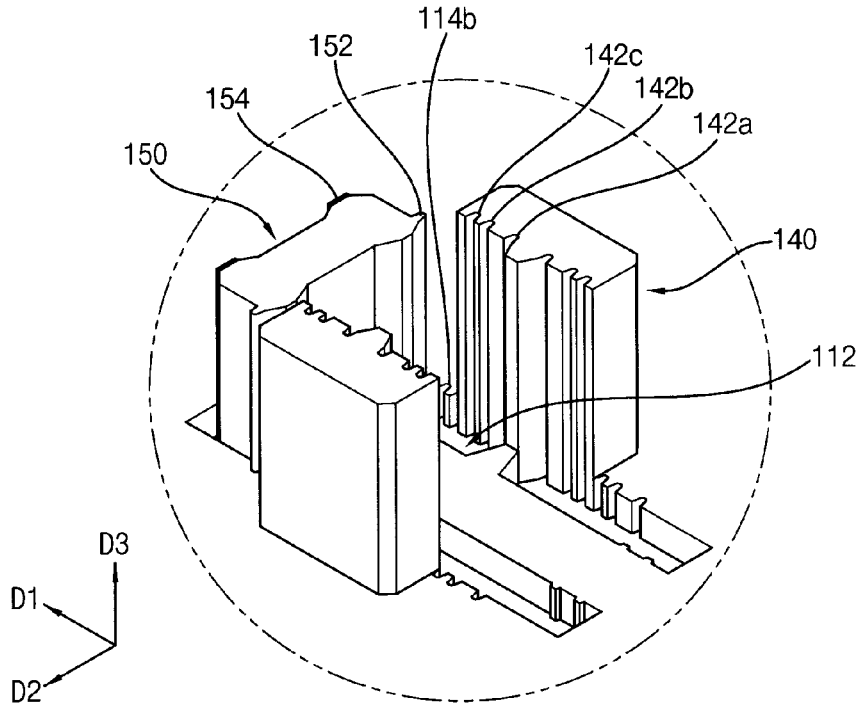

FIG. 6 is a plan view illustrating a guide recess for guiding the second positioning block in FIG. 5. FIG. 7 is a bottom view illustrating the second positioning block 150 in FIG. 5. FIG. 8 is a rear view illustrating the second positioning block 150 in FIG. 5. FIG. 9 is a perspective view illustrating the second positioning block 150 engaged with the guide recess in FIG. 6.

Referring to FIGS. 6 to 9, in exemplary embodiments, guide recesses 112 and 113 of the second engaging portion for guiding and supporting the second positioning block 150 are defined. The guide recesses 112 and 113 may be disposed in the bottom surface 110 of the body 100. The guide recesses 112 and 113 may extend in the third direction D1.

In this case, the second positioning block 150 may further include a guiding portion 156 (FIG. 8) that protrudes from a bottom surface of the second positioning block 150. The guiding portion 156 of the second positioning block 150 may be inserted into the guide recess 112. Accordingly, the second positioning block 150 may be supported by the guide recess 112 by the guiding portion 156.

The second engaging portion may include a plurality of fifth positioning latching members that is arranged in the third direction D1 toward the accommodating space S1. The second positioning block 150 may be engaged with any one of the fifth positioning latching members to adjust a capacity of the accommodating space S1 corresponding to the engagement position in the third direction D1.

As illustrated in FIG. 6, a plurality of third rib recesses 114*a*, 114*b* and 114*c* of the fifth positioning latching members may be defined in a sidewall of the guide recess 112 to be spaced apart from one another in the third direction D1. The third rib recesses 114*a*, 114*b* and 114*c* may be disposed respectively in the sidewall of the guide recess 112. The third rib recess may extend in the upward direction D3.

Two guide recesses 112 and 113 may be defined in the bottom surface 110 of the body to be spaced apart from each other. The first and second guides 140 and 141 may extend from the guide recesses 112 and 113 respectively. The second rib recesses 142*a*, 142*b* and 142*c* may extend from the sidewalls of the first and second guides 140 and 141 to the sidewalls of the guide recesses 112 and 113. The second rib recesses 142*a*, 142*b* and 142*c* and the third rib recesses 114*a*, 114*b* and 114*c* may be spaced apart from one another by a predetermined distance in the third direction D1.

Accordingly, the second protrusion 152 of the second positioning block 150 may be interference fitted with any one of the second rib recesses 142*a*, 142*b* and 142*c* and the third rib recesses 114*a*, 114*b* and 114*c*.

Further, at least one supporting protrusion 115*a*, 115*b* (refers to FIG. 6) may be disposed in another sidewall of the guide recess 112. The supporting protrusion may extend in the upward direction D3. At least one supporting recess 158*a* or 158*b* (refers to FIG. 7) may be disposed in a sidewall of the guiding portion 156 of the second positioning block 150. The supporting protrusions 115*a* and 115*b* may be interference fitted with the supporting recesses 158*a* and 158*b* respectively. Accordingly, when the second protrusion 152 of the second positioning block 150 is engaged with any one of the third rib recesses 114*a*, 114*b* and 114*c*, the supporting protrusions 115*a* and 115*b* may be engaged with the supporting recesses 158*a* and 158*b* such that the second positioning block 150 may be securely fitted with the body 100.

Figure 10:
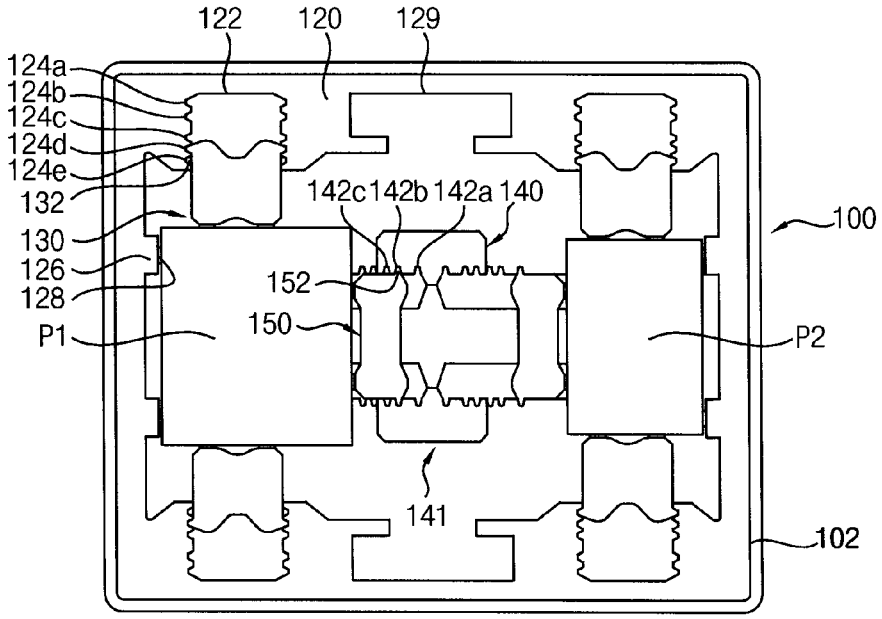

FIG. 10 is a plan view illustrating substrates having different sizes and received in the substrate storage container in FIG. 1.

Referring to FIGS. 3 and 10, the body 100 may have two first and second accommodating spaces S1 and S2 in both sides of the first and second guides 140 and 141.

A capacity of the first accommodating space 51 may be adjusted by a combination of engagement positions of the first and second positioning blocks 130 and 150 to receive a first substrate P1 having a first size. A capacity of the second accommodating space S2 may be adjusted by a combination of engagement positions of the first and second positioning blocks 130 and 150 to receive a second substrate P2 having a second size different from the first size. Accordingly, the first and second substrates P1 and P2 having different sizes may be received in the first and second accommodating spaces S1 and S2 respectively.

In an exemplary embodiment, the first substrates P1 may be stacked on one another in the first accommodating space 51 of the body 100. Every two adjacent first substrates P1 may be spaced by a spacing sheet (not illustrated). The second substrates P2 may be stacked on one another in the second accommodating space S2 of the body 100. Every two adjacent second substrates P2 may be spaced by a spacing sheet (not illustrated).

Figure 11:
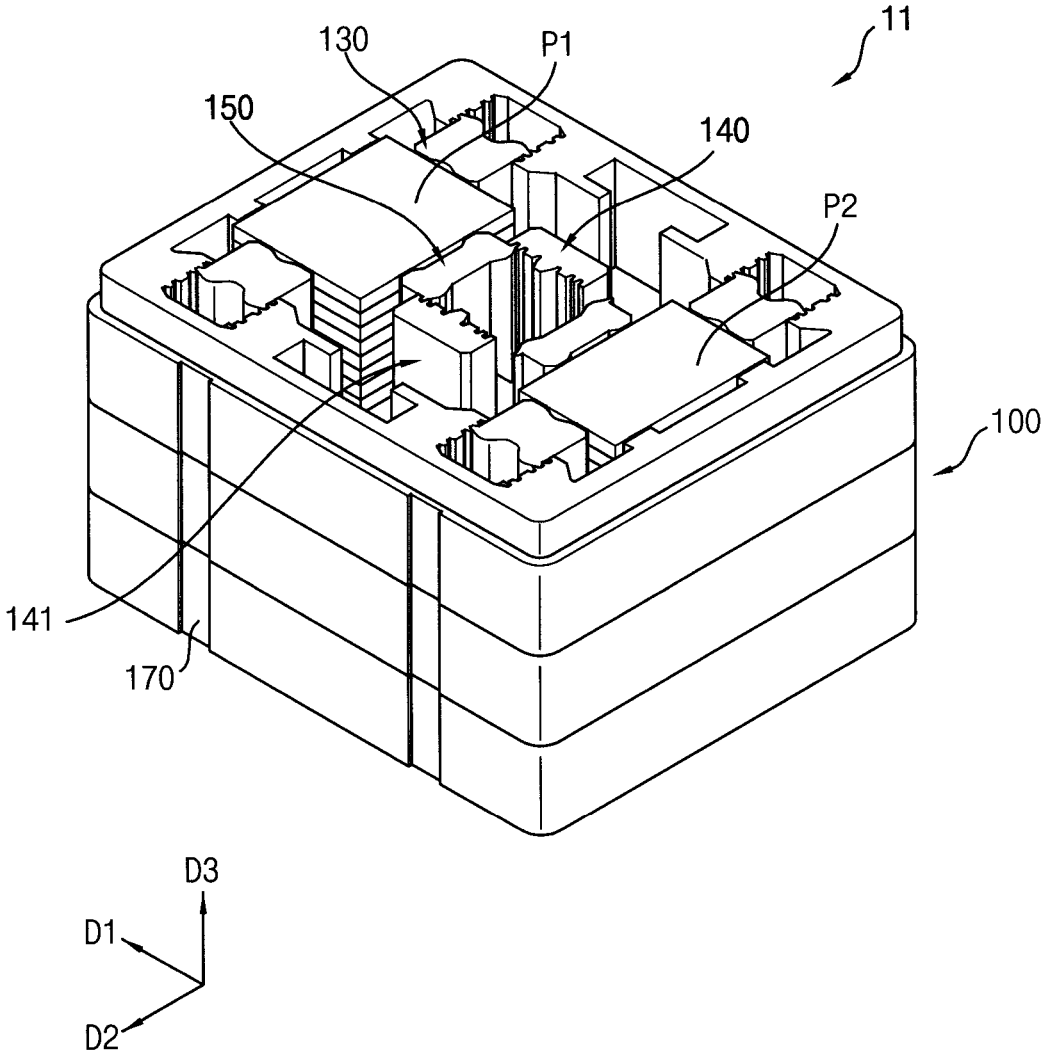

FIG. 11 is a perspective view illustrating a substrate storage container in accordance with exemplary embodiments. The substrate storage container may be substantially the same as or similar to the substrate storage container in FIG. 1, except for a structure of stacked bodies. Thus, same reference numerals will be used to refer to the same or like elements as those described in the substrate storage container in FIG. 1, and any further repetitive explanation concerning the above elements will be omitted.

Referring to FIG. 11, a substrate storage container 11 may include a plurality of bodies 100. A first step portion 102 (see FIG. 1) may be disposed in an upper sidewall of the body 100, and a second step portion (not illustrated) may be disposed in a lower sidewall of the body 100 corresponding to the first step portion 102.

Accordingly, a plurality of the bodies 100 may be stacked on one another by an engagement of the first and second step portions. A cover 200 (refers to FIG. 1) may be attached on an uppermost surface of the body 100.

In an exemplary embodiment, a bandage (not illustrated) may be provided to surround the substrate storage container 11 along fixing recesses 170 and 230 in outer sidewalls of the body 100 and the cover 200. Accordingly, the substrate storage container 11 including a plurality of the bodies 100 stacked therein may be transport and store a plurality of substrates.

The foregoing is illustrative of exemplary embodiments and is not to be construed as limiting thereof. Although a few exemplary embodiments have been described, those skilled in the art will readily appreciate that many modifications are possible in exemplary embodiments without materially departing from the novel teachings and advantages of the invention. Accordingly, all such modifications are intended to be included within the scope of exemplary embodiments as defined in the claims. In the claims, means-plus-function clauses are intended to cover the structures described herein as performing the recited function and not only structural equivalents but also equivalent structures. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A substrate storage container, comprising:

a body including a bottom surface and a plurality of sidewalls extending perpendicularly from the bottom surface in a first direction to cooperatively provide an accommodating space for receiving a substrate;

a first engaging portion provided in at least one sidewall of the plurality of sidewalls of the body and including a plurality of first positioning latching members which is arranged toward the accommodating space in a second direction perpendicular to the first direction;

a first positioning block detachably engaged with the first engaging portion and including a second positioning latching member which is engaged with any one of the plurality of first positioning latching members to adjust a capacity of the accommodating space corresponding to an engagement position of the second positioning latching member in the second direction;

a second engaging portion protruding from the bottom surface of the body and including a plurality of third positioning latching members which is arranged toward the accommodating space in a third direction perpendicular to the first and second directions; and a second positioning block detachably engaged with the second engaging portion and including a fourth positioning latching member which is engaged with any one of the plurality of third positioning latching members to adjust a capacity of the accommodating space corresponding to an engagement position of the fourth positioning latching member in the third direction, wherein the second engaging portion further comprises a plurality of fifth positioning latching members which is arranged in the third direction toward the accommodating space, and the second positioning block is engaged with any one of the plurality of fifth positioning latching members to adjust a capacity of the accommodating space corresponding to an engagement position of the plurality of fifth positioning latching members in the third direction.

2. The substrate storage container of claim 1, wherein a receiving recess for receiving the first positioning block is defined in the first engaging portion.

3. The substrate storage container of claim 2, wherein a plurality of first rib recesses of the first positioning latching members is defined in a sidewall of the receiving recess, and the second positioning latching member includes a first protrusion which is disposed in a sidewall of the first positioning block to be interference fitted with any one of the first rib recesses.

4. The substrate storage container of claim 2, wherein the first positioning block further comprises a first contact pad portion which is provided on a sidewall of the first positioning block and contacts the substrate.

5. The substrate storage container of claim 1, wherein the second engaging portion comprises first and second guides which face each other to receive the second positioning block.

6. The substrate storage container of claim 5, wherein a plurality of second rib recesses of the plurality of third positioning latching members is defined in at least one sidewall of the first and second guides to be spaced apart from one another in the third direction, and the fourth positioning latching member is a second protrusion which is disposed in a sidewall of the second positioning block to be interference fitted with any one of the plurality of second rib recesses.

7. The substrate storage container of claim 1, wherein the second positioning block further comprises a second contact pad portion which is provided on a sidewall of the second positioning block to contact the substrate.

8. The substrate storage container of claim 1, wherein the third direction is perpendicular to the second direction.

9. The substrate storage container of claim 1, wherein a guide recess of the second engaging portion is defined in the bottom surface of the body to guide and support the second positioning block.

10. The substrate storage container of claim 1, wherein a plurality of third rib recesses of the plurality of fifth positioning latching members is defined in a sidewall of the guide recess to be spaced apart from one another in the third direction, and the second protrusion of the second positioning block is interference fitted with any one of the plurality of second and third rib recesses.

11. The substrate storage container of claim 1, wherein the second positioning block further comprises a guiding portion which protrudes from a bottom surface of the second positioning block to be inserted into the guide recess.

12. The substrate storage container of claim 11, wherein a supporting protrusion is disposed in a sidewall of the guide recess, a supporting recess is defined in a sidewall of the guiding portion of the second positioning block, and the supporting protrusion is interference fitted with the supporting recess.

13. The substrate storage container of claim 1, wherein the body further comprises a subsidiary block portion which protrudes from at least one of the plurality of sidewalls of the body to support the substrate.

14. The substrate storage container of claim 13, wherein the subsidiary block portion further comprises a third contact pad portion which is provided on a sidewall of the subsidiary block portion to contact the substrate.

15. The substrate storage container of claim 1, further comprising a cover attached on the body.

16. The substrate storage container of claim 1, wherein an end of the sidewall of the body includes a step portion.

17. The substrate storage container of claim 1, wherein the body comprises plastic.

18. The substrate storage container of claim 1, wherein the first positioning block comprises plastic.

* * * * *